US010634470B2

(12) United States Patent
D'Acquisto

(10) Patent No.: US 10,634,470 B2
(45) Date of Patent: Apr. 28, 2020

(54) HUNTING ARROW

(71) Applicant: Andrae T. D'Acquisto, Bellevue, IA (US)

(72) Inventor: Andrae T. D'Acquisto, Bellevue, IA (US)

( * ) Notice: Subject to any disclaimer, the term of this patent is extended or adjusted under 35 U.S.C. 154(b) by 0 days.

(21) Appl. No.: 16/447,058

(22) Filed: Jun. 20, 2019

(65) Prior Publication Data

US 2020/0018578 A1 Jan. 16, 2020

Related U.S. Application Data

(60) Provisional application No. 62/744,418, filed on Oct. 11, 2018, provisional application No. 62/696,621, filed on Jul. 11, 2018.

(51) Int. Cl.

| | |
|---|---|
| ***F42B 6/04*** | (2006.01) |
| ***F42B 12/36*** | (2006.01) |
| ***F42B 6/08*** | (2006.01) |

(52) U.S. Cl.

CPC ..... *F42B 6/04* (2013.01); *F42B 6/08* (2013.01); *F42B 12/362* (2013.01)

(58) Field of Classification Search

CPC ..... F42B 6/04; F42B 6/08; F42B 12/362
See application file for complete search history.

(56) References Cited

U.S. PATENT DOCUMENTS

| | | | | |
|---|---|---|---|---|
| 4,277,069 | A | 7/1981 | Rouse | |
| 4,380,340 | A * | 4/1983 | Simo | F42B 6/04 473/577 |
| 4,671,517 | A | 6/1987 | Winters | |
| 5,762,574 | A * | 6/1998 | Mashburn | F42B 6/04 473/581 |
| 7,115,055 | B2 | 10/2006 | Palomaki et al. | |
| 7,651,421 | B2 | 1/2010 | Smith et al. | |
| 8,475,303 | B2 | 7/2013 | James | |
| 9,366,509 | B2 | 6/2016 | Connolly | |
| 9,410,773 | B2 | 8/2016 | Greenwood | |
| 9,658,037 | B2 | 5/2017 | James | |
| 2009/0163308 | A1 | 6/2009 | Odabachian et al. | |

OTHER PUBLICATIONS https://www.bloodhoundhunting.com, © 2017.
Victory VAP Shok Aluminum Insert; © 2017 Lancaster Archery Supply, Inc.

* cited by examiner

*Primary Examiner* — John A Ricci
(74) *Attorney, Agent, or Firm* — Ryan Kromholz & Manion, S.C.

(57) ABSTRACT

One or more void spaces is provided toward the leading tip of an arrow for hunting, and void spaces are provided toward the trailing tip. The void spaces toward the leading tip can be supplied at the broadhead, behind the broadhead, at a shaft insert, or at the arrow shaft itself. The void space or spaces toward the trailing tip can be supplied at the nock, in front of the nock, at a shaft insert placed between the nock and the arrow shaft, or at the arrow shaft itself. The passageway is provided from at or near leading tip of the arrow, through the arrow shaft, to at or near the trailing tip of the arrow. Blood can be expelled from any of the void spaces, and the void spaces can also allow air to enter the passageway and into the cavity of the game.

3 Claims, 8 Drawing Sheets

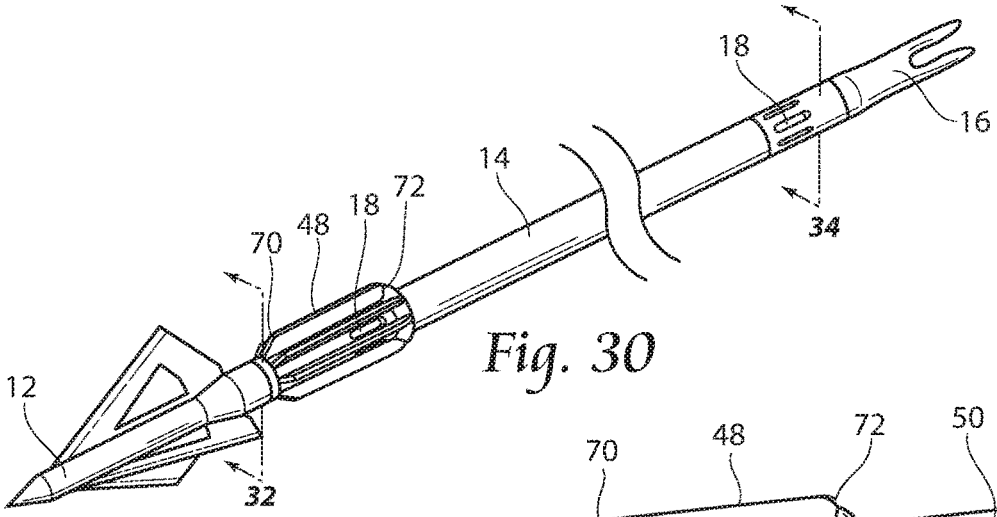
Fig. 30
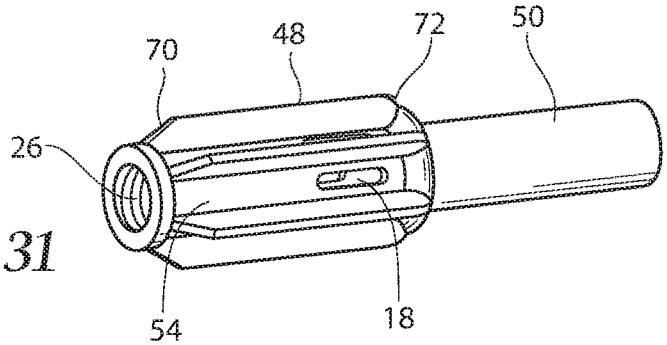
Fig. 31
Fig. 32
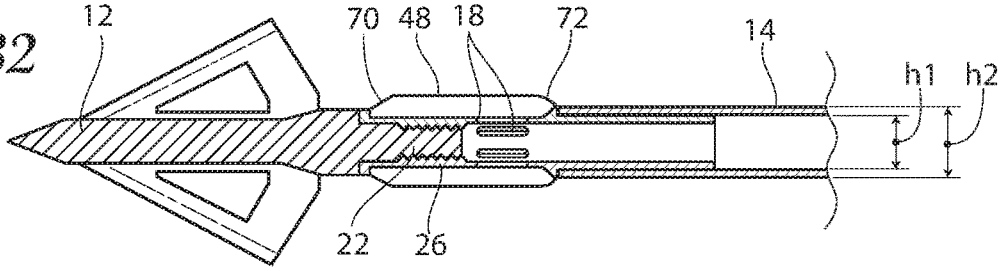
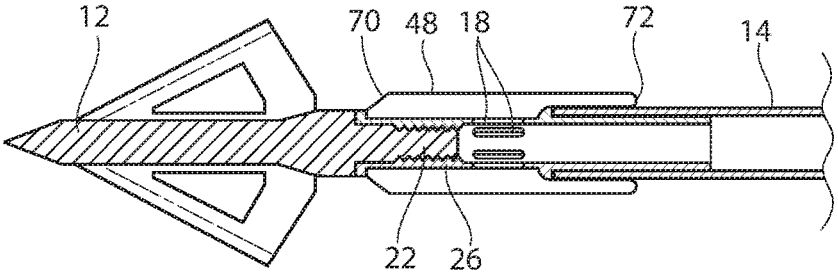
Fig. 33
Fig. 34
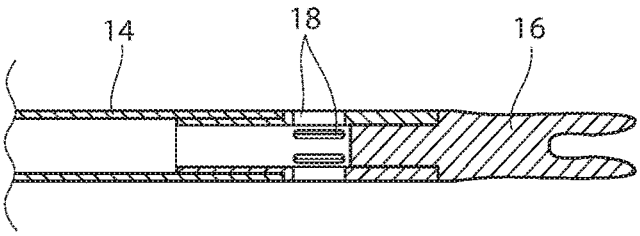

HUNTING ARROW

RELATED APPLICATIONS

This application claims the benefit of Provisional Application Ser. Nos. 62/696,621, filed 11 Jul. 2018 and 62/744,418, filed 11 Oct. 2018.

BACKGROUND OF THE INVENTION

Hunting arrows are equipped generally with a broadhead at its tip for penetration, which is affixed to a shaft which is generally hollow and constructed of, for instance, aluminum or carbon, and at its tail, the hollow shaft is coupled to a nock for propelling the arrow by a string shot from a bow.

It is desirable for hunters to cause a blood trail on a struck animal. Hunters use the blood trail to assist in recovery of game.

For certainly lethal shot placement, blood trailing is relatively simple. For marginal shot placement, hunters observe that partial penetration of an arrow can cause an arrow to plug the entrance hole, minimising expelled blood for trailing. If game receives a one lung hit, the remaining lung remains viable, increasing the distance game can travel after being hit.

SUMMARY OF THE INVENTION

The present invention aids blood trail formation by allowing a passageway for both air to enter an internal cavity of the game, and for blood to be expelled from the passageway.

In a preferred embodiment, one or more void spaces is provided toward the leading tip, and another one or more void spaces is provided toward the trailing tip. The void space or spaces toward the leading tip can be supplied at the broadhead, behind the broadhead, at a shaft insert placed between the broadhead and the arrow shaft, or at the arrow shaft itself. The void space or spaces toward the trailing tip can be supplied at the nock, in front of the nock, at a shaft insert placed between the nock and the arrow shaft, or at the arrow shaft itself.

The passageway is provided from at or near leading tip of the arrow, through the arrow shaft, to at or near the trailing tip of the arrow. Blood can be expelled from any of the void spaces, and the void spaces can also allow air to enter the passageway and into the cavity of the game.

The present invention comprises a front insert carried by an arrow, said arrow comprising a hollow cylinder comprising a center, an inner radius, an outer radius and a length, said insert comprising a leading edge, a trailing edge, and an interior; an insert length between said leading edge and said trailing edge; a first and a second vane extending along at least a portion of said insert length; a valley between said vanes; a front insert void space carried within said valley; said front insert void space in fluid communication with said interior and through said trailing edge; said vanes extending from said center of said arrow greater than said outer radius of said arrow;

and said vanes further comprising a nose contour of increasing height from said center of said arrow from said leading edge. In one embodiment, a front insert can further comprise a trailing contour of decreasing height from said center of said arrow toward said trailing edge. In an additional embodiment, a front insert can be provided in combination with a rear insert, said rear insert comprising a leading edge, a middle portion, and a trailing edge, said middle portion comprising rear insert void spaces in fluid communication with said front insert void space, said rear insert carrying an independent nock of said arrow.

Other benefits of the present invention comprise that the inserts serve as a vortex generator. In other words, the arrow is an axis around an insert or inserts of the present invention cause rotation of air flow. The resulting flight of the arrow is flatter, more accurate (no fishtailing), with better flesh penetrating characteristics.

BRIEF DESCRIPTION OF THE DRAWINGS

FIG. 30 is a perspective view of an additional embodiment of a leading insert carried by an arrow;

FIG. 31 is a perspective view of the leading insert of FIG. 30;

FIGS. 32-34 are cross sectional views of leading and trailing inserts of FIG. 30.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
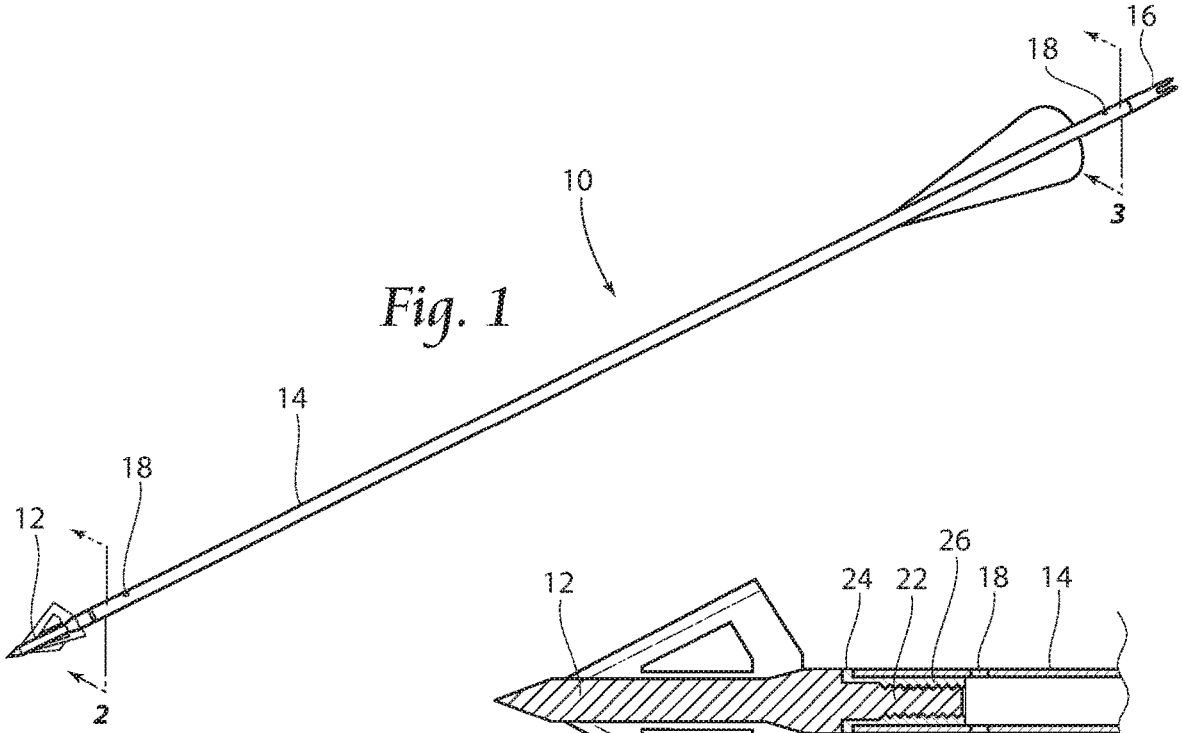
FIG. 1 is a perspective view of an arrow modified in accordance with the present invention.

Referring now to FIG. 1 a perspective view of an arrow 10 modified in accordance with the present invention is shown. The arrow 10 generally comprises a broadhead 12, a shaft 14, and a nock 16. In accordance with the present invention, void spaces 18 are installed at various venting locations, preferably at or near the leading and trailing portions on the arrow shaft 14 to provide a fluid pathway from the leading portion of the arrow 14, through a hollow arrow shaft 14, to the trailing portion of the arrow 14.

As will be described later, the void spaces 18 provide fluid pathways for exit of blood from game, and entrance of air into a cavity of the animal.

Figure 2:
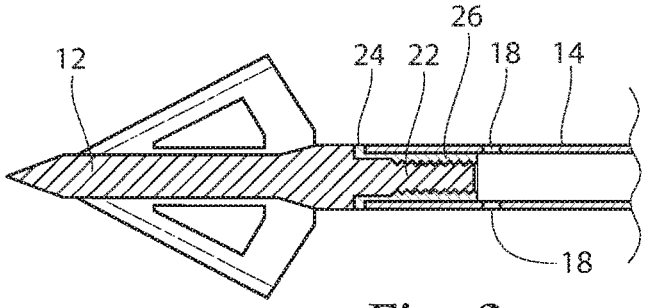
FIG. 2 is a side cross sectional view of a leading portion of the arrow of FIG. 1.

FIG. 2 is a side cross sectional view of a leading portion of the arrow 10 of FIG. 1. Typically, a broadhead 12 has a threaded portion 22, which is received by a female threaded portion 26 of a broadhead insert 24 to securely join the broadhead 12 to the arrow shaft 14. In one embodiment of the present invention, void spaces 18 are provided in the shaft of the arrow behind the insert 24 (although the void spaces 18 can be placed elsewhere).

Figure 3:
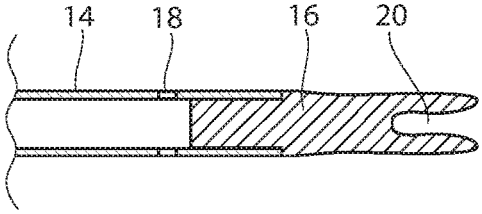
FIG. 3 is a side cross sectional view of a trailing portion of the arrow of FIG. 1.

Referring now to FIG. 3, at a trailing portion of the arrow shaft 14, void spaces 18 can be provided in front of a nock 16, which in use carries a string of a bow (not shown) in a nock bow string receiver 20 for propelling the arrow 10.

Figure 4:
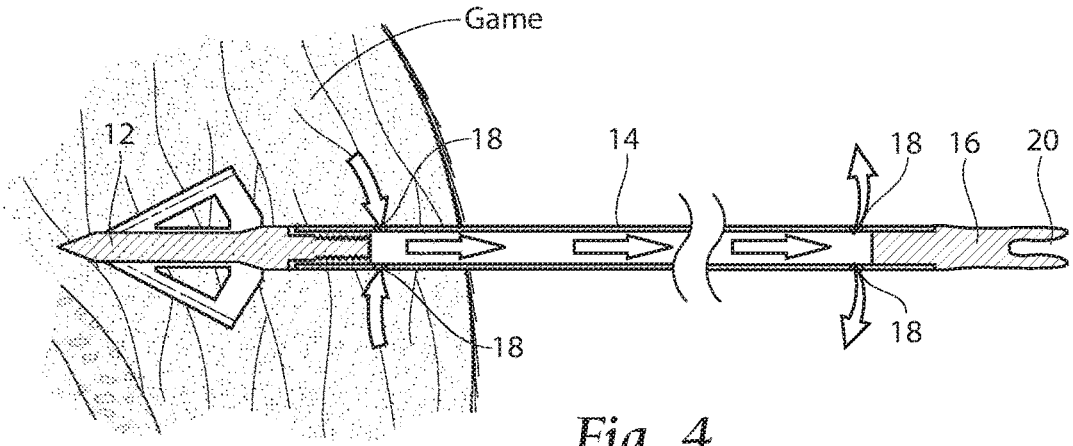
FIG. 4 is a side cross sectional, in-use view of the arrow of FIG. 1.

Referring now to FIG. 4, a side cross sectional, in-use view of the arrow 10 is shown, entering game (such as a deer). The game is pierced by broadhead 12. The game typically leaves a blood trail prior to expiring, and hunters follow the blood trail to locate and retrieve the game. It is advantageous to have a vigorous blood trail, to make locating the game easier. In some instances, arrow 10 will completely pass through the game. In other instances, arrow 10 will pass part way through, remaining lodged for instance in bone, organ or muscle tissue. Void spaces 18 allow a fluid pathway (shown by arrows) for blood to enter the hollow arrow shaft 14 and exit rear void spaces 18. Due to fluid hydraulics, internal pressure of the blood in game exits void spaces 18 with a great velocity, advantageously causing an increased blood trail for the hunter to follow. For marginal shot placement, hunters observe that partial penetration of arrow 10 can cause an arrow to plug the entrance hole, minimizing expelled blood for trailing. Void spaces 18 provide the desired pathway for egress of blood from the internal cavity of the game, in lieu of, or in addition to, blood egressing from the entrance or exit wound. If game receives a one lung hit, the remaining lung remains viable, increasing the distance game can travel after being hit. In this instance, ingress of air into void spaces 18 into the game cavity can assist the remaining lung to collapse under pressure from the introduced air.

Figure 5:
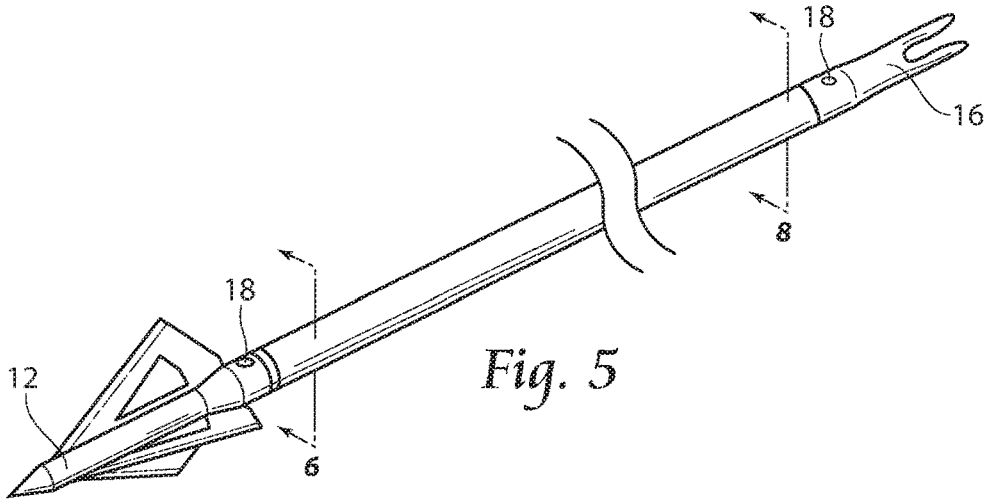
FIG. 5 is a perspective view of an arrow modified in accordance with an alternate embodiment of present invention, with a void space provided both at a broadhead and at a nock.
Figure 6:
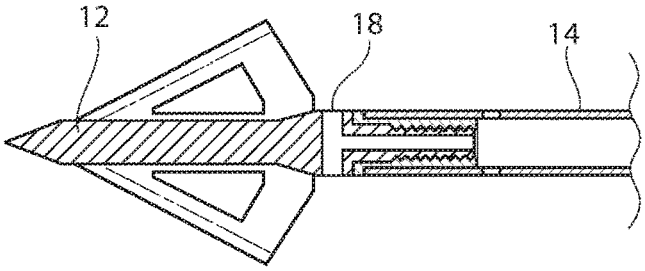
FIG. 6 is a side cross-sectional view of a leading portion of the arrow of FIG. 5.

Referring now to FIG. 5, a perspective view of an arrow 10 modified in accordance with an alternate embodiment of present invention is shown. In this embodiment, shown in perspective in FIG. 5 and in cross section in FIG. 6, voids 18 are provided in the broadhead 12 itself, with void space 18 in this instance extending through the threaded portion 22 of the broadhead to provide the fluid pathway. Similarly, nock 16 can carry voids 18.

Figure 7:
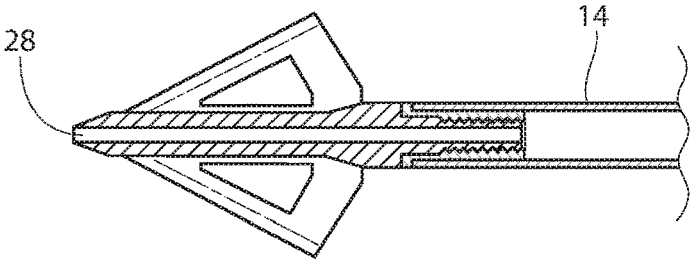
FIG. 7 is a side cross-sectional view of an arrow modified in accordance with a second alternate embodiment of present invention, with a void space provided at the tip of a broadhead.
Figure 8:
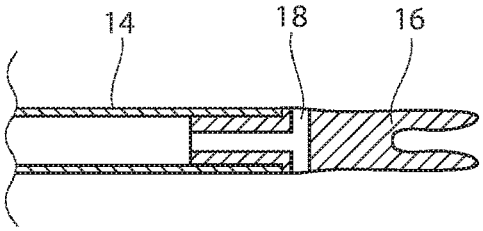
FIG. 8 is a side cross-sectional view of a trailing portion of the arrow, with a void space provided through a nock.
Figure 9:
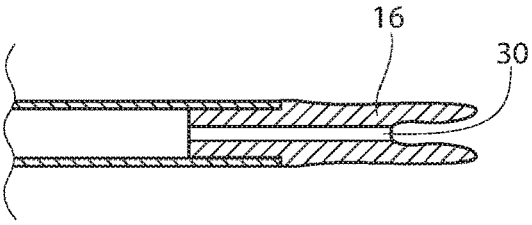
FIG. 9 is a side cross-sectional view of a trailing portion of the arrow, with a void space provided axially through a nock.

Referring now to FIG. 7, a broadhead hollow point and passageway 28 can be provided to communicate fluid. In this embodiment, the broadhead hollow point and passageway 28 serves as the void space for fluid communication, from the cavity of the game to the void spaces 18, for instance shown in cross section in FIG. 8 (void space through the nock 16 itself), or FIG. 19, with nock hollow end and passageway 30 serving as the exit for fluid. For passageways such as passageway 28, air is flowing through the arrow, rather than being deflected entirely by the arrow.

In other embodiments of broadheads provided with channels, such as shown in FIG. 7, channels can be provided to put blades into, for instance in two-blade, three-blade, 4-blade, 5-blade, 6-blade configurations and so on. The channels provided on a broadhead, whether provided through a tip as shown in FIG. 7, or alongside blades as described above, cause flight and blood tracking characteristics to considerably and surprisingly improve. The channels and inserts of the present invention cause "lift" or more accurately, prevention of drop, of the arrow during flight. These structures can also be provided as "outserts" on the outside of the arrow, such as a structure that can be outfitted about an arrow shaft behind a broadhead for instance. Such structures could be formed of plastics or rubber for instance.

Figure 10:
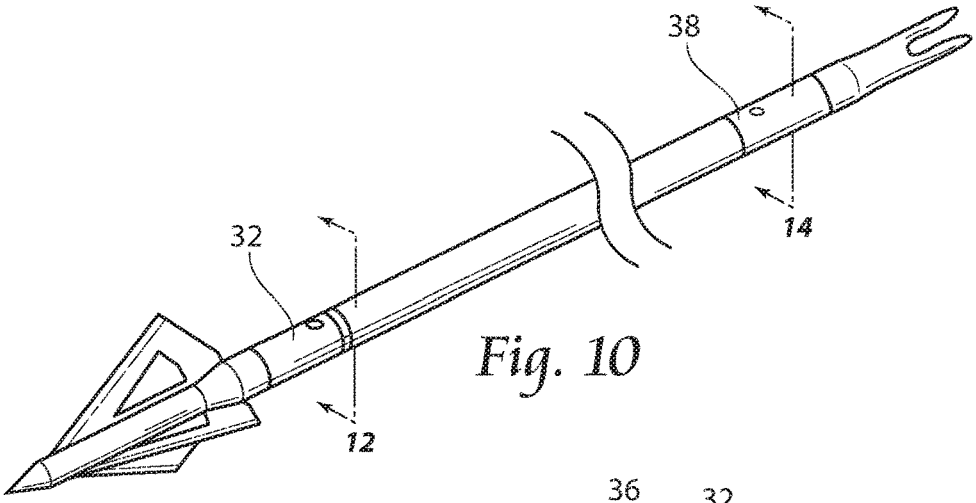
FIG. 10 is a perspective view of an arrow modified in accordance with an alternate embodiment of the present invention, with an insert provided between the broadhead and the arrow shaft, and an insert provided between the nock and the arrow shaft, with the void space(s) provided on the inserts.

Referring now to FIG. 1, perspective view of an arrow modified in accordance with an alternate embodiment of the present invention, with front insert 32 and rear insert 38 is shown. In this embodiment, referring now to FIGS. 10 and 11, an independent insert 32 is provided between the broadhead 12 and the arrow shaft 14, and/or a rear insert 38 is provided between the nock 16 and the arrow shaft 14, with the void space(s) 18 provided on the inserts 32 and/or 38.

Figure 11:
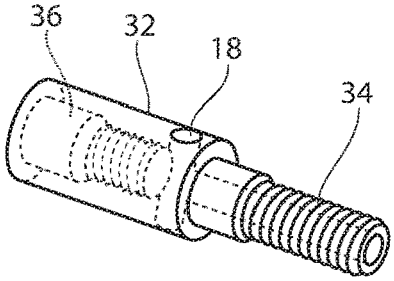
FIG. 11 is a perspective view, with portions shown in phantom, of a leading insert, with an external male threaded portion for coupling to an internal threaded insert contained by the arrow shaft, and an internal female threaded portion for receiving a male threaded portion from a typical broadhead.
Figure 12:
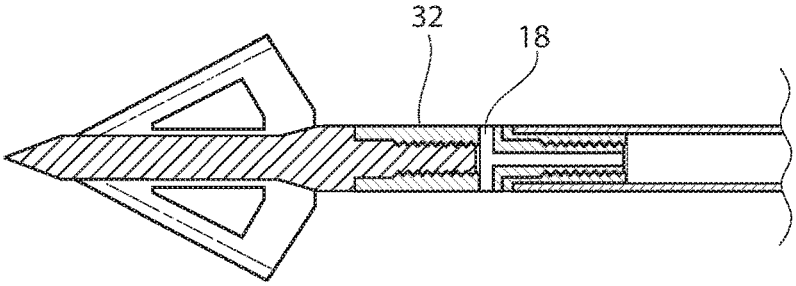
FIG. 12 is a side cross-sectional view of the leading insert of FIG. 11 carrying a broadhead, the insert coupled with the arrow shaft.
Figure 13:
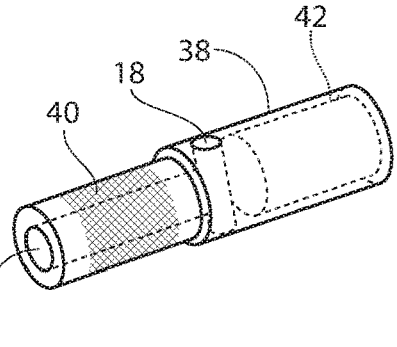
FIG. 13 is a perspective view, with portions shown in phantom, of a trailing insert with an external knurled portion for coupling to the arrow shaft, and an internal female portion for receiving a nock.
Figure 14:
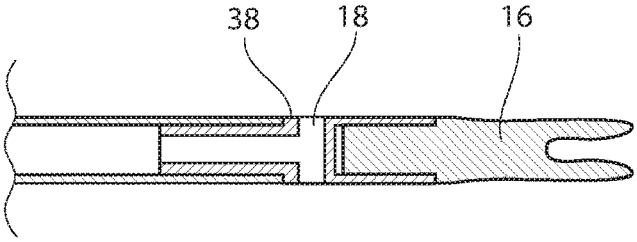
FIG. 14 is a side cross-sectional view of the trailing insert of FIG. 13 carrying a nock, the trailing insert coupled with the arrow shaft.

Referring now to FIG. 11, leading insert 32 with an external male threaded portion 34 for coupling to an internal threaded insert 24 (see FIG. 12) is shown. Internal female threaded portion 36 carries the threads 22 from broadhead 12. Voids 18 are provided for air to enter insert 32 and exit through the pathway through male threaded portion 32. Similarly, referring to FIGS. 13 and 14, rear insert 38 has a female receiver 42 for carrying nock 16 (ordinarily by glue), and knurled portion 40 can carry glue to couple with the arrow shaft 14. Void space 18 can be configured through and into the arrow shaft 14 to complete the fluid passageway.

Figure 15:
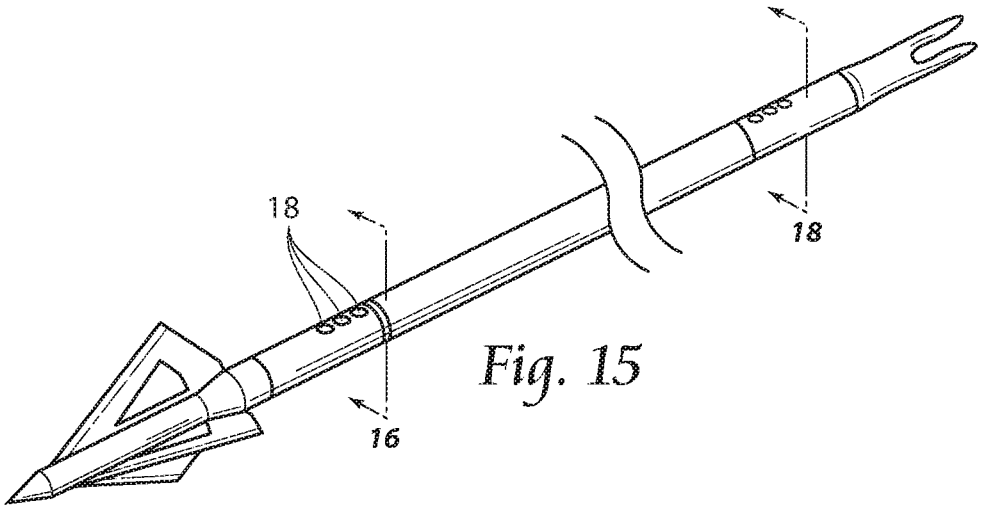
FIG. 15 an alternate embodiment of the leading and trailing inserts.
Figure 16:
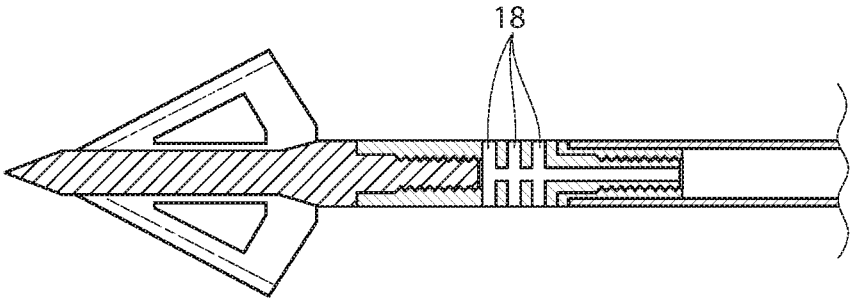
FIG. 16 is a side cross-sectional view of the leading insert of FIG. 15 carrying a broadhead, the insert coupled with the arrow shaft.
Figure 17:
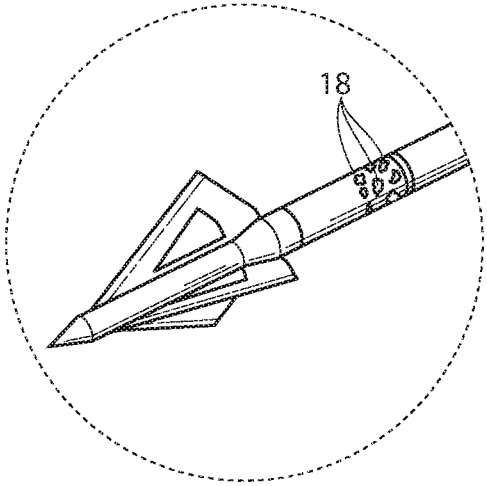
FIG. 17 is a second alternate embodiment of the leading insert.
Figure 18:
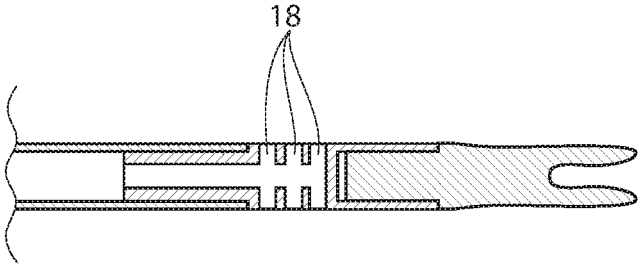
FIG. 18 is a side cross-sectional view of the trailing insert of FIG. 15 carrying a nock, the trailing insert coupled with the arrow shaft.

Referring now to FIG. 15 an alternate embodiment of the leading 32 and trailing inserts 33 is shown, with multiple void spaces for increasing fluid volume potential as shown in FIGS. 16 and 18. Alternatively, patterned void spaces 18 can be provided as shown in FIG. 17.

Figure 19:
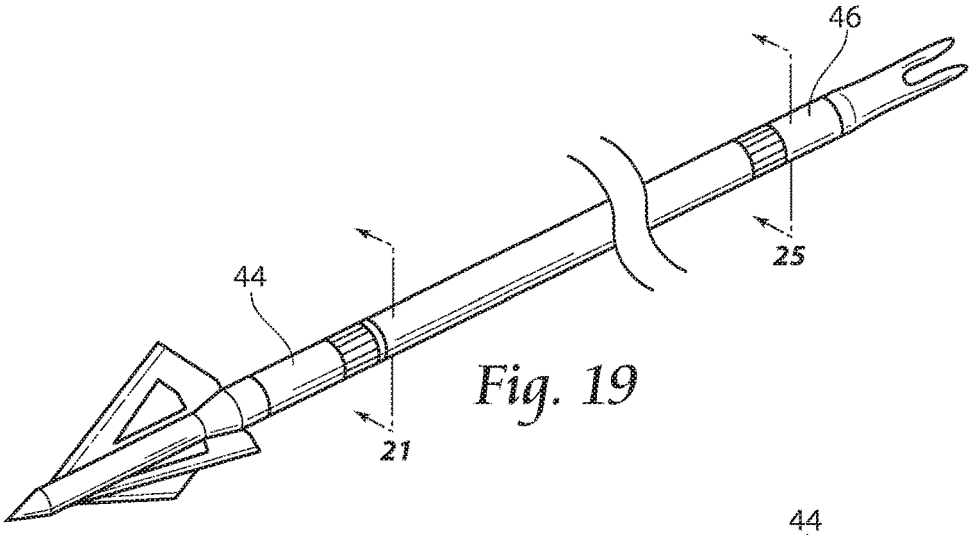
FIG. 19 is a third alternate embodiment of the leading and trailing inserts.
Figure 20:
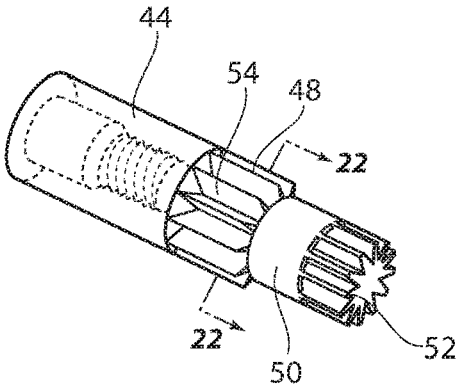
FIG. 20 is a perspective view, with portions shown in phantom, of the leading insert of FIG. 19 with an external ridged and ringed portion for coupling to the arrow shaft, and an internal female portion for receiving a broadhead.
Figure 21:
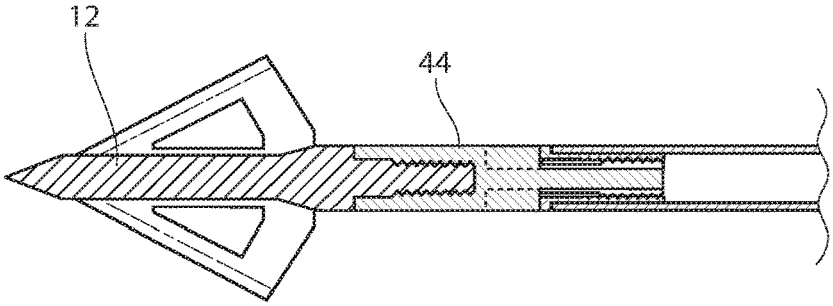
FIG. 21 is a side cross-sectional view of the leading insert of FIG. 21 carrying a broadhead, the insert coupled with the arrow shaft.
Figure 22A:
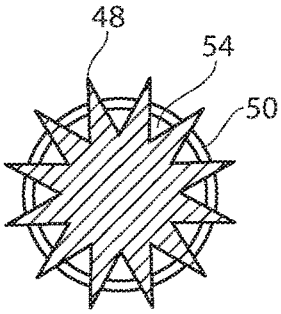
FIGS. 22A and 22B are cross sectional views of alternate ridge arrangements of the insert of FIG. 20.
Figure 22B:
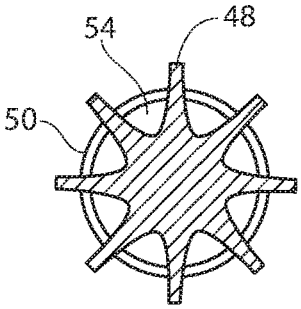
Figure 23:
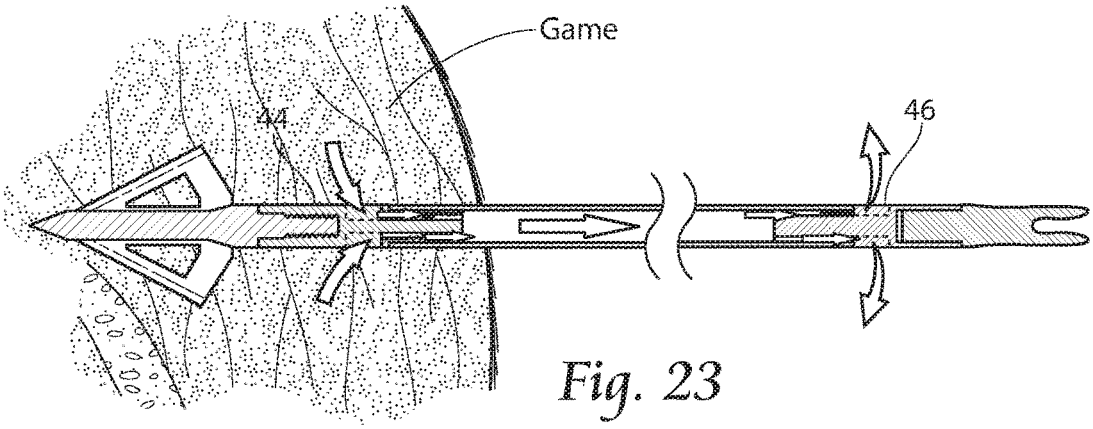
FIG. 23 is a side cross sectional, in-use view of the arrow of FIG. 10, with the passageway providing a pathway for internal blood from the game to exit the arrow.
Figure 25:
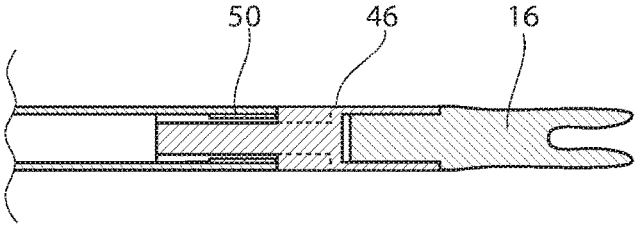
FIG. 25 is a side cross-sectional view of the trailing insert of FIG. 24*b* carrying a nock, the insert coupled with the arrow shaft.

Referring now to FIG. 19, an additional third alternate embodiment of ridged and vented leading and trailing inserts 44 and 46 respectively, is shown. In this embodiment, referring now to FIG. 20, front ridged and vented insert 44 is provided with external ridges 48, and internal ridges 52. A ring 50 is provided to carry glue for insertion into arrow shaft 14 (see FIG. 21). In this embodiment, a ridge under ring to ridge passageway 54, best shown in cross sections of FIGS. 22A and 22B, allows the fluid communication. Similarly, trailing ridged and ringed insert 46 can be used to carry the nock 16 (FIG. 25), and complete the fluid passage way from a similar a ridge under ring to ridge passageway 54 from exterior ridges 48 to interior ridges 52. In use, as shown in FIG. 23, the fluid can enter between external ridges 54, travel through ridge under ring to ridge passageway 54 and into the shaft 14, and exit the trailing insert 46, when the broadhead and leading insert enter game.

Figure 24A:
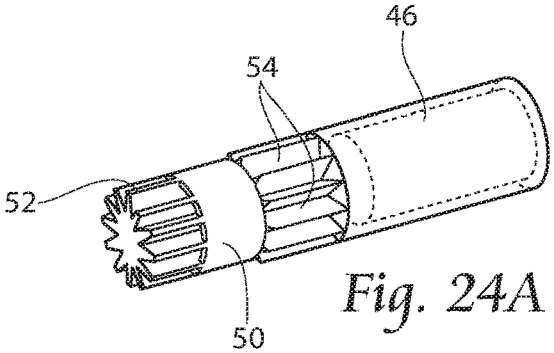
FIGS. 24A and 24B are perspective views, with portions shown in phantom, of the leading and trailing inserts of FIG. 19, respectively with an external ridged and ringed portion for coupling to the arrow shaft, and an internal female portion for receiving a broadhead and a nock, respectively.
Figure 24B:
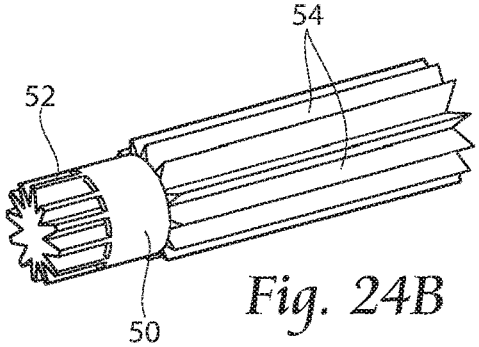

FIGS. 24A and 24B are perspective views, with portions shown in phantom, of the leading and trailing inserts of FIG. 19.

Figure 26:
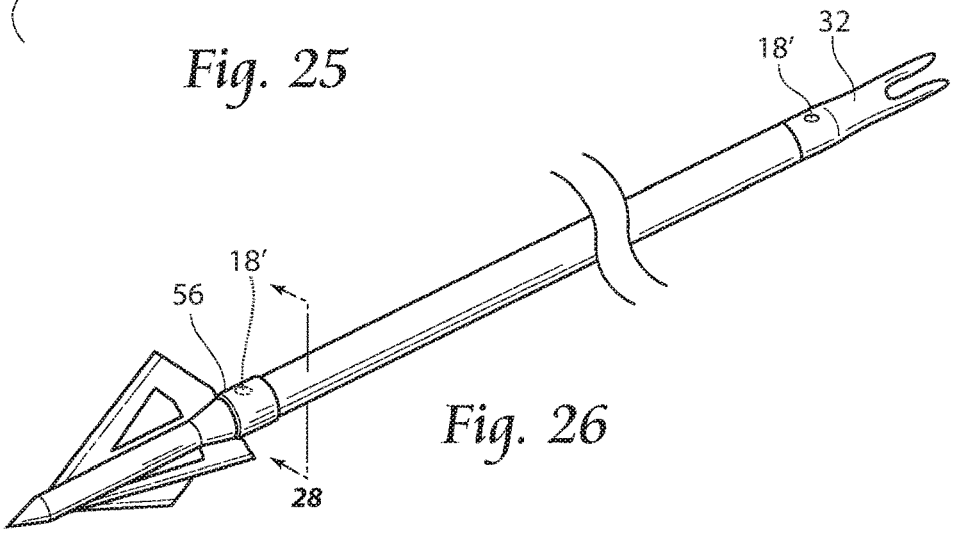
FIG. 26 is a side perspective view of an alternate embodiment of leading and trailing inserts with temporarily closed void spaces.
Figure 27:
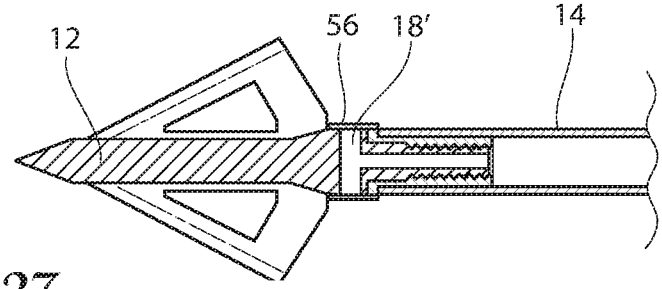
FIG. 27 is a side cross-sectional view of the leading insert of FIG. 26 carrying a broadhead, the insert coupled with the arrow shaft.
Figure 28:
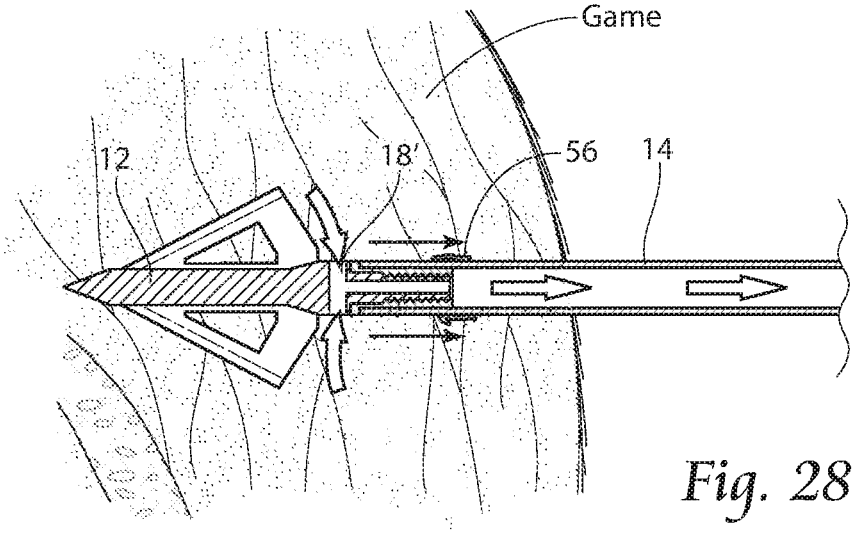
FIG. 28 is a side cross sectional, in-use view of the arrow of FIG. 26, with the temporarily closed void spaces becoming opened upon impact, with the passageway providing a pathway for internal blood from the game to exit the arrow.

Referring now to FIG. 26, a side perspective view of an additional alternate embodiment of leading and trailing inserts 32 and 38 with temporarily closed void spaces 18 is shown. In this embodiment, void spaces 18 are concealed until impact, as shown in cross section in FIG. 27. Impact, as shown in FIG. 28, causes a temporary void space cover 56 to move away from the void spaces 18, allowing the fluid passageway to remain closed during flight, and to open following impact.

Figure 29:
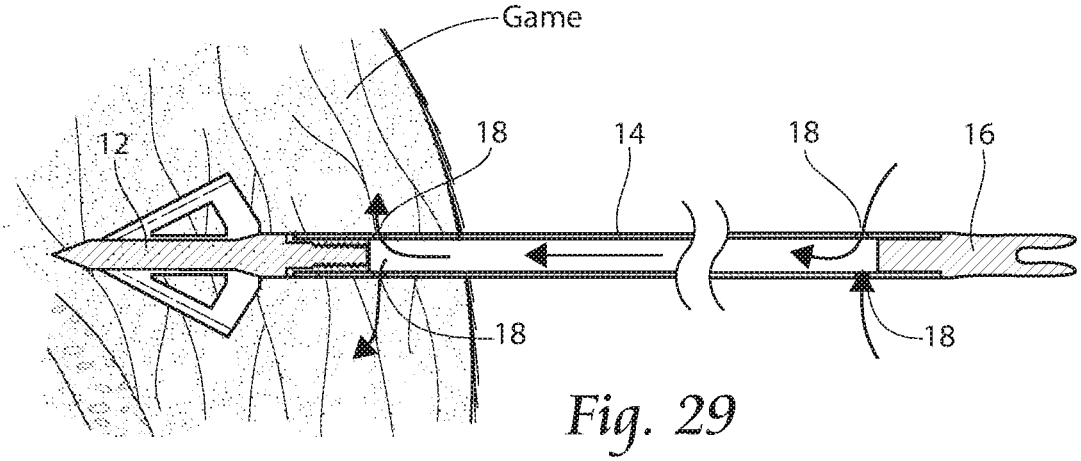
FIG. 29 is a side cross sectional, in-use view of the arrow of any of the preceding figures, with the passageway providing an entry pathway for air to enter the cavity of the game.

Referring now to FIG. 29, the present invention allows for an additional benefit after blood flow has ceased. Namely, the void spaces 18 then provide an entry pathway for air to enter the cavity of the game, which increases the likelihood of dispatch by filling the internal cavity with air.

Referring now to FIG. 30, ridges 48 can take on different configurations, as ridge to ridge passageway 54 can contain voids 18, with ridges 58 having a leading nose contour 70 and a trailing contour 72. As shown in FIG. 31, such a configuration allows the insert to be glued by ring 50 (preferably hollow, to allow passage of blood as previously described) into the hollow arrow shaft 14.

As shown in FIG. 32, in a preferred embodiment, arrow shaft 14 has a height (or diameter) h1, and the distance between opposing edges 48 is h2, with h2 being larger than h1. In this configuration, ridges 48 serve to maintain further spread of tissue in the animal to encourage bleeding, and also serve as structural rigidity support for the arrow 14 and insert.

In FIG. 33, an alternate embodiment is shown, with trailing contour 72 covering, or extending along on an outside surface of a portion of arrow shaft 14. Such an insert can be used with a trailing insert as well, such as that shown in FIG. 34.

While not bound by any particular theory of operation, advantageously, the inserts of the present invention described above create a vortex by removing part of the slow-moving boundary layer in contact with the arrow surface 14, delaying aerodynamic stalling, thereby improving the effectiveness of vanes/feathers (such as those shown towards the rear of arrow 10 in FIG. 1) and the remaining arrow surface 14. The insert flutes rapidly move outside air into the slow-moving boundary layer in contact with the surface ensuring the effectiveness of trailing edge arrow surfaces.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A front insert carried by an arrow, said arrow comprising a hollow cylinder comprising a center, an inner radius, an outer radius and a length, said insert comprising:

a leading edge, a trailing edge, and an interior;

an insert length between said leading edge and said trailing edge;

a first and a second vane extending along at least a portion of said insert length;

a valley between said vanes;

a front insert void space carried within said valley;

said front insert void space in fluid communication with said interior and through said trailing edge;

said vanes extending from said center of said arrow greater than said outer radius of said arrow;

said vanes further comprising a nose contour of increasing height from said center of said arrow from said leading edge.

2. A front insert according to claim 1, said vanes further comprising a trailing contour of decreasing height from said center of said arrow toward said trailing edge.

3. A front insert according to claim 1 in combination with a rear insert, said rear insert comprising a leading edge, a middle portion, and a trailing edge, said middle portion comprising rear insert void spaces in fluid communication with said front insert to space, said rear insert carrying an independent nock of said arrow.

* * * * *